US011213729B2

(12) United States Patent
Aramaki

(10) Patent No.: US 11,213,729 B2
(45) Date of Patent: Jan. 4, 2022

(54) GOLF CLUB HEAD

(71) Applicant: Sumitomo Rubber Industries, Ltd., Kobe (JP)

(72) Inventor: Tomotaka Aramaki, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 17/172,467

(22) Filed: Feb. 10, 2021

(65) Prior Publication Data

US 2021/0252347 A1 Aug. 19, 2021

(30) Foreign Application Priority Data

Feb. 13, 2020 (JP) ..... JP2020-022585

(51) Int. Cl.
*A63B 53/04* (2015.01)

(52) U.S. Cl.
CPC ..... *A63B 53/0466* (2013.01); *A63B 53/0433* (2020.08); *A63B 53/0437* (2020.08); *A63B 2209/00* (2013.01)

(58) Field of Classification Search
CPC ..... A63B 53/0466; A63B 53/0433; A63B 53/0437; A63B 2209/00
USPC ..... 473/324–350, 287–292
See application file for complete search history.

(56) References Cited

U.S. PATENT DOCUMENTS 7,303,487 B2 * 12/2007 Kumamoto ..... A63B 53/0466 473/345
8,226,499 B2 * 7/2012 Soracco ..... A63B 53/0466 473/334
8,435,137 B2 * 5/2013 Hirano ..... A63B 53/0466 473/345
9,126,085 B2 * 9/2015 Sander ..... A63B 53/0466
2002/0187853 A1 * 12/2002 Beach ..... A63B 53/0466 473/345
2005/0159243 A1 * 7/2005 Chuang ..... A63B 53/0466 473/345
2005/0215354 A1 * 9/2005 Kumamoto ..... A63B 53/0466 473/349
2005/0272527 A1 * 12/2005 Sugimoto ..... A63B 53/0466 473/345
2008/0146375 A1 * 6/2008 Nakano ..... A63B 53/0466 473/350

(Continued)

FOREIGN PATENT DOCUMENTS

JP 5756305 B2 7/2015

*Primary Examiner* — Sebastiano Passaniti

(74) *Attorney, Agent, or Firm* — Birch, Stewart, Kolasch & Birch, LLP

(57) ABSTRACT

A golf club head includes a cover member, and a club head main body comprising a crown portion, a sole portion and a back-side outer rim portion. The club head main body is made of a first material. The club head main body is provided with a crown opening and a cutout. The cutout is made up of a first opening on the crown portion side and a second opening on the sole portion side, and these opening are connected with each other in the back-side outer rim portion. The width of the cutout and the contour length of the back-side outer rim portion in the top view of the club head are relative with each other. The cover member is made of a second material having a specific gravity lower than the first material. The crown cover closes the crown opening and the first opening. The sole cover closes the second opening.

20 Claims, 15 Drawing Sheets

(56) References Cited

U.S. PATENT DOCUMENTS

2009/0291775 A1* 11/2009 Hirano ..... A63B 53/0466
473/345
2012/0225734 A1 9/2012 Nishio

* cited by examiner

GOLF CLUB HEAD

CROSS-REFERENCE TO RELATED APPLICATION

This application claims the benefit of foreign priority to Japanese Patent Application No. 2020-022585 filed 13 Feb. 2020, which is incorporated by reference in its entirety.

FIELD OF THE INVENTION

The present invention relates to a golf club head having a hollow therein.

BACKGROUND OF THE INVENTION

In recent years, there have been proposed golf club heads in which materials having different specific gravities are used in order to lower the position of the center of gravity of the club head (see, for example, Patent Document 1 below).

Patent document 1: Japanese Patent No. 5756305

SUMMARY OF THE INVENTION

Problems to be Solved by the Invention

In recent years, in addition to lowering of the center of gravity of a golf club head, there is a need to design the center of gravity of the club head at various positions (for example, face side or heel side) according to the skill of the user and the golf club number. At that time, it is also necessary to suppress deterioration of fundamental performances of a golf club head such as rebound performance, durability and hitting sound.

The present invention was made in view of the above circumstances, and a primarily objective of the present invention is to provide a golf club head in which the degree of freedom in designing the center of gravity of the club head can be increased, while suppressing deterioration of the fundamental performances of the club head.

According to the present invention, a golf club head with a hollow therein comprise: a club head main body having a crown portion, a sole portion, and a back-side outer rim portion therebetween; and a cover member, wherein the club head main body is made of a first material, the club head main body is provided with a crown opening and a cutout, the crown opening is formed in the crown portion, the cutout is formed by a first opening on the crown portion side and a second opening on the sole portion side which are connected with each other in the back-side outer rim portion, in a top view of the club head, a width of the cutout measured in the back-side outer rim portion is in a range from 0.5% to 30% of a contour length of the back-side outer rim portion, the cover member is made of a second material having a specific gravity smaller than that of the first material, the cover member integrally includes a crown cover and a sole cover which extends from the crown cover into the sole portion while turning back, the crown cover closes the crown opening and the first opening of the cutout, and the sole cover closes the second opening of the cutout.

In the golf club head according to the present invention, the first opening of the cutout may be connected to the crown opening.

In a top view of the club head, the cutout may penetrate from the crown portion to the sole portion through the hollow.

In a top view of the club head, the cutout may be provided so as to include a position of the club head which is most rearward of the club head.

In a top view of the club head, the cutout may be provided so as to include a region rearward of a sweet spot of a face portion.

In a top view of the club head, the cutout may be provided so as to include a region rearward of the center of gravity of the club head.

In a top view of the club head, the cutout may be provided on the toe side of the center of gravity of the club head.

In a top view of the club head, the cutout may be provided on the heel side of the center of gravity of the club head.

The specific gravity of the second material may be 2.0 or less.

At least a part of the club head main body around the cutout may be provided with a receiving area for supporting the sole cover, and the sole cover may be adhered to the receiving area by an adhesive agent which extends from the receiving area to an inner surface of the club head main body beyond an opening edge of the cutout.

In the golf club head according to the present invention, since the above-described configurations are adopted, it is possible to increase the degree of freedom in designing the center of gravity of the club head, while suppressing deterioration of fundamental performances of the club head such as the lowered center of gravity, rebound performance, durability and hitting sound.

DESCRIPTION OF THE PREFERRED EMBODIMENTS

Figure 1:
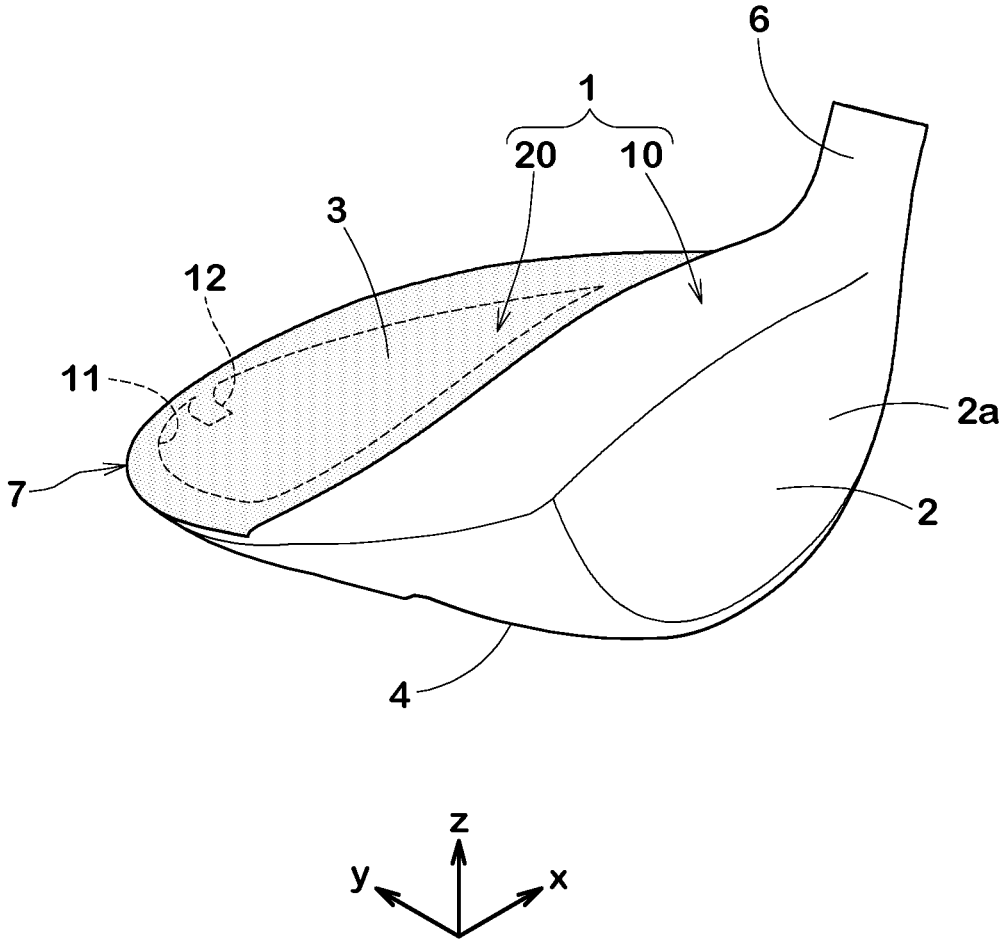
FIG. 1 is a perspective view of a golf club head as an embodiment of the present invention.

Hereinafter, embodiments of the present invention will be described with reference to the drawings.

The specific configurations detailed below in the embodiments and shown in the drawings are for understanding the subject matter of the present invention, and the present invention is not limited to the specific configurations shown. It should be understood that, in the following description, the same or common elements are given the same reference numerals, and redundant descriptions are omitted.

FIGS. 1 to 6 respectively show a perspective view, a top view, a side view, a rear view, a bottom view, and an exploded perspective view of a golf club head 1 as an embodiment of the present invention.

Further, FIGS. 1 to 6 show the club head 1 under its reference state.

[Head Reference State]

In this application including the description and claims, dimensions, positions, directions and the like relating to the club head refer to those under a reference state of the club head unless otherwise noted.

Figure 2:
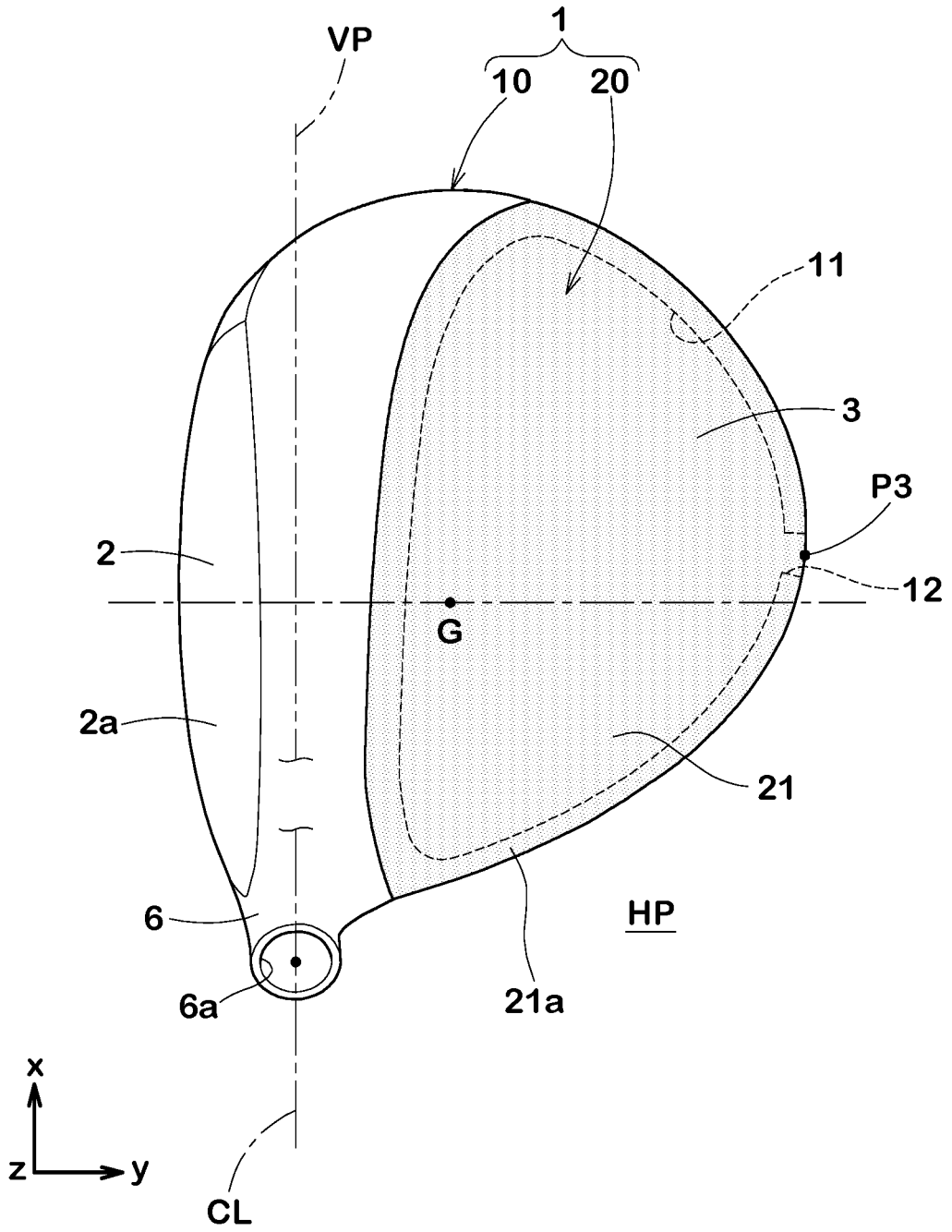
FIG. 2 is a top view of the golf club head.
Figure 3:
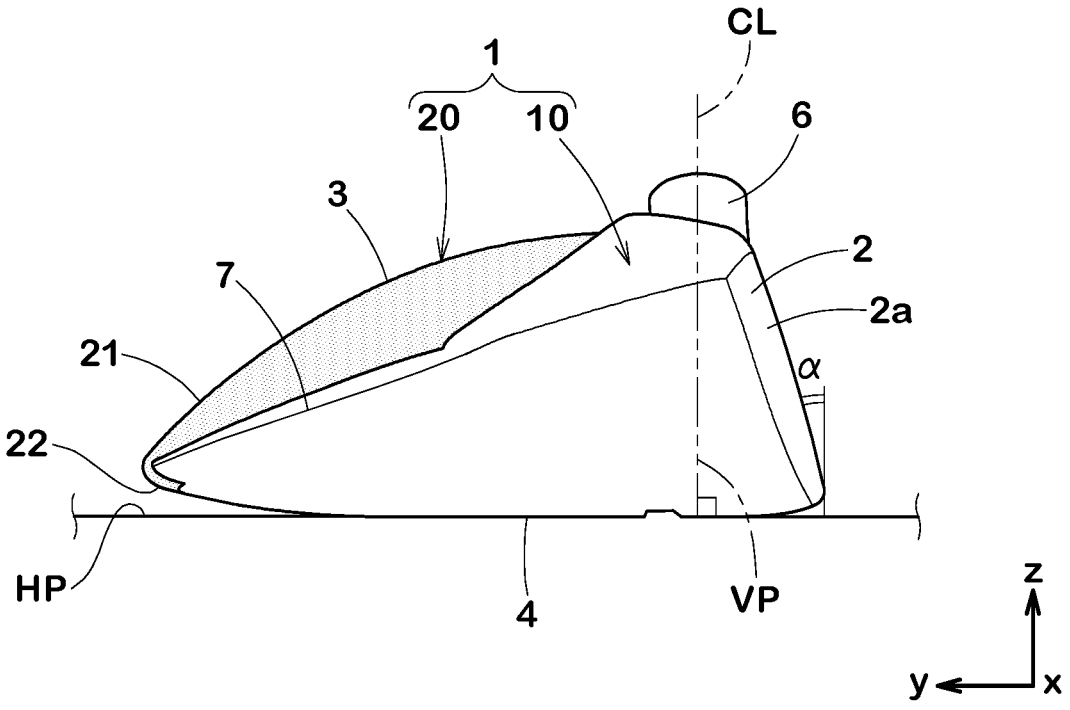
FIG. 3 is a side view of the golf club head as viewed from its toe side.
Figure 4:
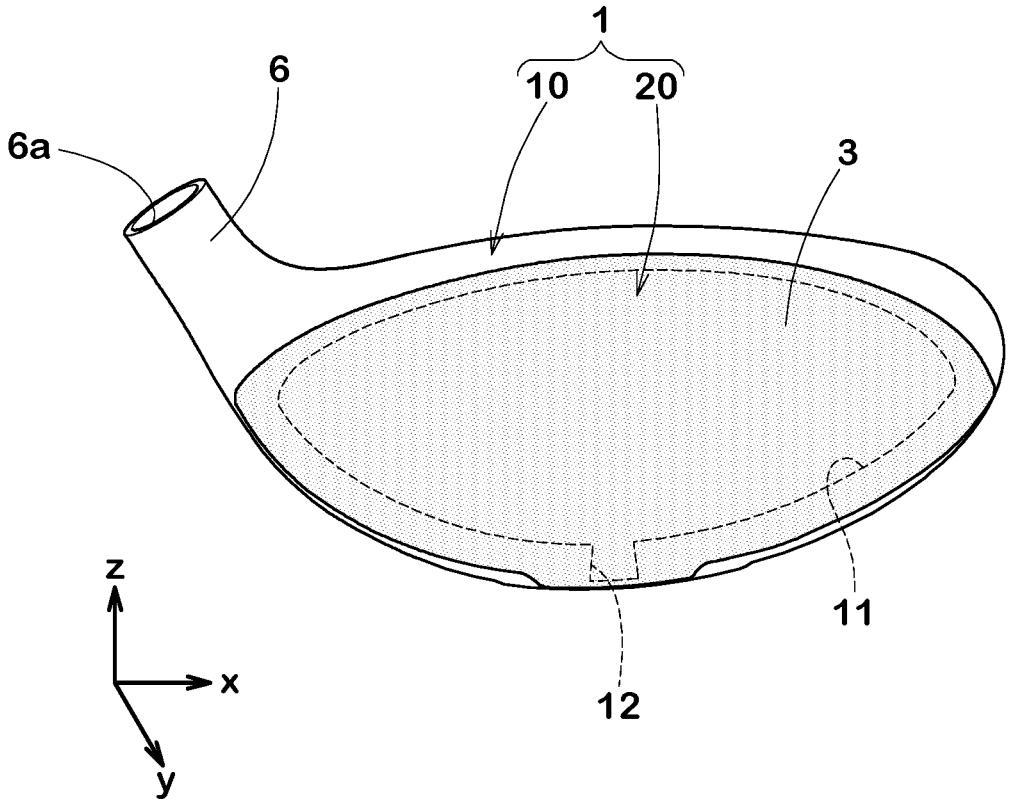
FIG. 4 is a rear view of the golf club head.

Here, the reference state of a club head is such that the club head is set on a horizontal plane HP as shown in FIG. 3 so that the axis CL of the club shaft (not shown) is inclined at the specified lie angle (not shown) while keeping the axis on a vertical plane VP as shown in FIG. 2, and the face forms the specified loft angle alpha as shown in FIG. 3.

Incidentally, in the case of the club head alone, the center line of the shaft inserting hole can be used instead of the axis cl of the club shaft.

[Directions about the Club Head]

In this application, three orthogonal directions are defied in connection with the club head 1 under the reference state as follows.

The toe-heel direction of the club head is a direction x parallel with the horizontal plane HP and the vertical plane VP.

The front-rear direction of the club head is a direction y orthogonal to the vertical plane VP. In the front-rear direction of the club head, the face portion 2 side is the front side, and the opposite side is the rear side (also referred to as the back side).

The up-down direction of the club head is a direction z orthogonal to both the directions x and y.

[Basic Configuration of the Club Head]

In FIGS. 1 to 6, the club head 1 in the present embodiment has a hollow (i) therein (FIG. 6) and formed as a wood-type head.

The wood-type head includes a driver (#1) and a fairway wood. The head 1 may be formed as, for example, a utility-type head as long as it has a hollow (i).

The head 1 comprises a face portion 2, a crown portion 3, and a sole portion 4, and these portions are arranged so as to define the hollow (i) therein.

The hollow (i) may be filled with, for example, a foamed material, a gel-like material, or the like, if necessary.

[Face Portion]

The face portion 2 is a portion for hitting a ball and is formed on the front side of the club head 1.

The outer surface (front surface) of the face portion 2 constitutes a striking surface 2*a* that comes into contact with the ball. The striking surface 2*a* may be provided with grooves so called score lines extending in the toe-heel direction.

[Crown Portion]

The crown portion 3 extends from the upper edge of the face portion 2 toward the rear of the club head so as to form the upper surface of the club head. The crown portion 3 forms a portion of the club head which can be seen in the top view of the club head as shown in FIG. 2, excluding the face portion 2 and the hosel portion 6.

As shown in FIG. 3, the crown portion 3 is smoothly inclined so as to gradually approach the horizontal plane HP toward the rear of the club head.

Further, on the heel side of the crown portion 3, a hosel portion 6 is provided.

The hosel portion 6 is provided with a shaft inserting hole 6*a* into which a club shaft (not shown) is fixed.

As described above, the center line of the shaft inserting hole 6*a* can be used instead of the axis cl of the club shaft when determining the reference state.

[Sole Portion]

The sole portion 4 extends from the lower edge of the face portion 2 toward the rear of the club head so as to form the bottom surface of the club head.

Figure 5:
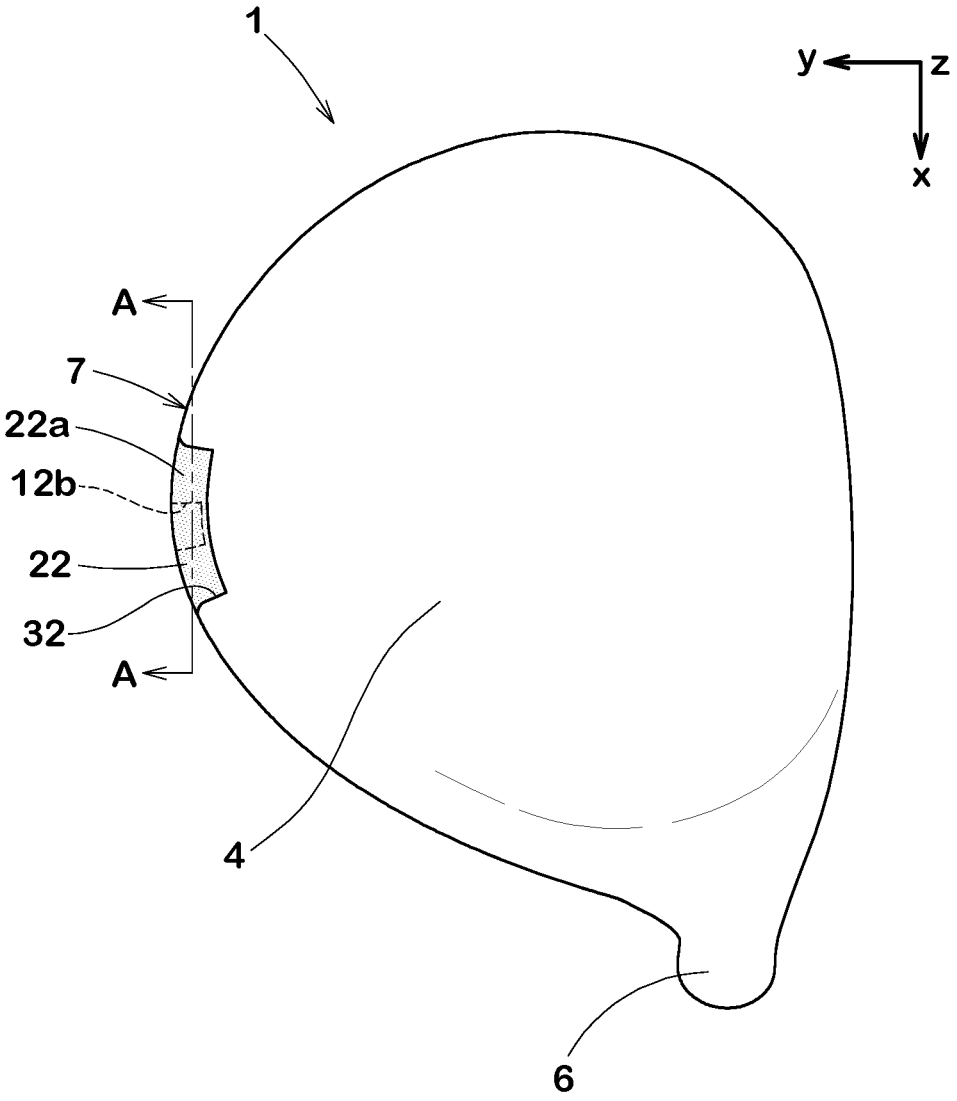
FIG. 5 is a bottom view of the golf club head.

The sole portion 4 forms a portion of the club head which can be seen in the bottom view of the club head as shown in FIG. 5, excluding the hosel portion 6.

In this embodiment, the rear side of the sole portion 4 is gradually curved upward and connected to the crown portion 3 as shown in FIG. 3. And, as can be seen from FIG. 3, the crown portion 3 and the sole portion 4 are directly connected.

In this embodiment, the club head 1 is composed of a club head main body 10 and a cover member 20.

[Club Head Main Body]

The club head main body 10 is made of first material.

The club head main body 10 in the present embodiment constitutes a framework of the club head 1.

In order to increase the durability of the club head 1, it is preferable that the first material is a metal material, for example, a titanium alloy or stainless steel.

In the present embodiment, the club head main body 10 is made of stainless steel.

Figure 7:
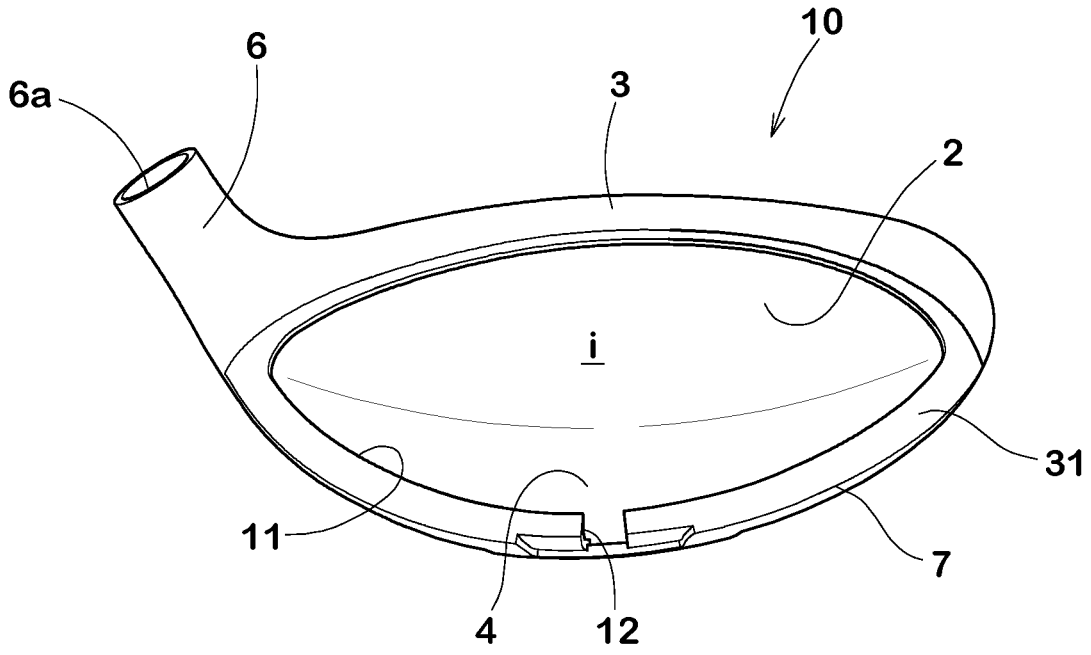
FIG. 7 is a rear view of the club head main body of the golf club head.
Figure 8:
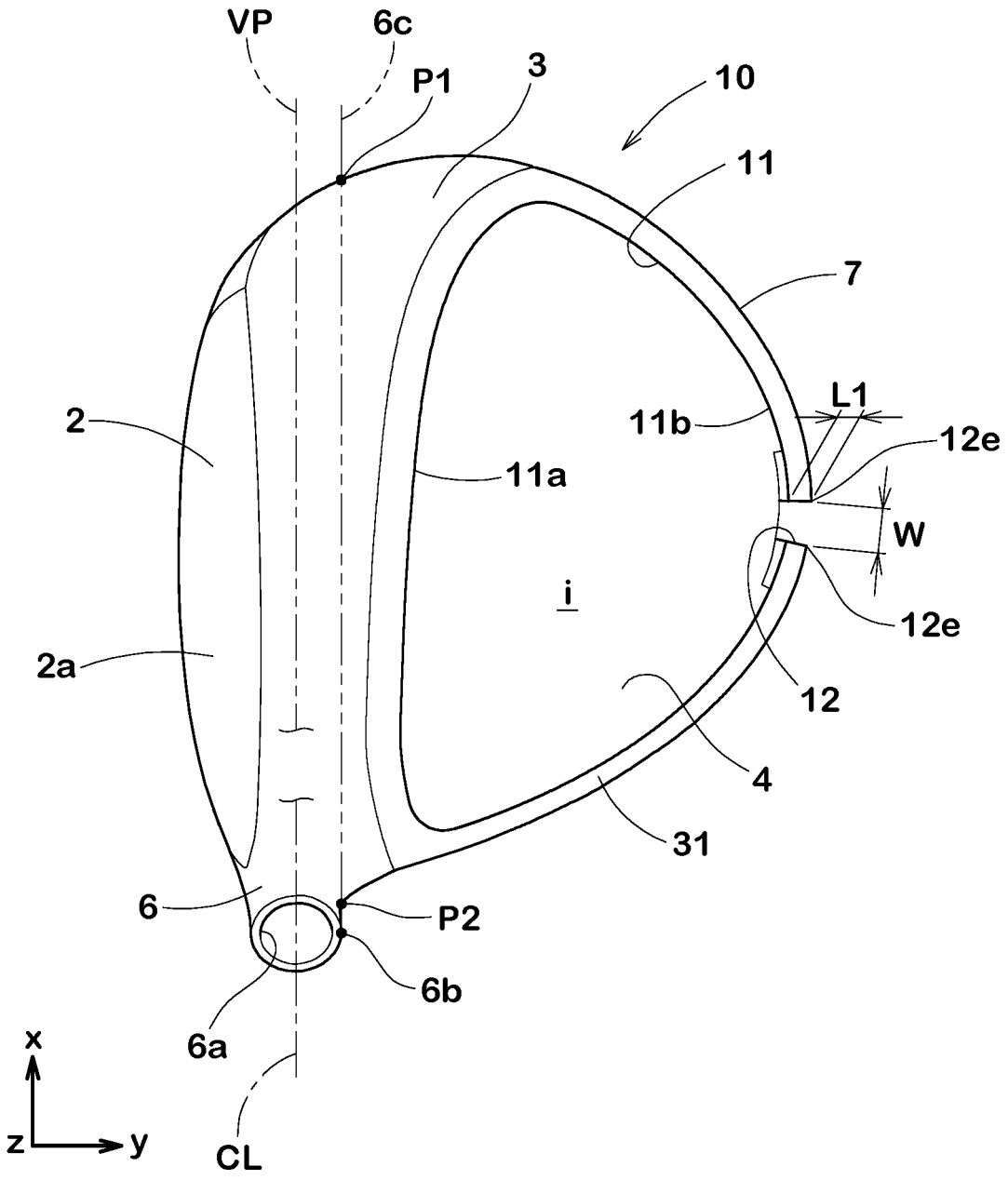
FIG. 8 is a top view of the club head main body.
Figure 9:
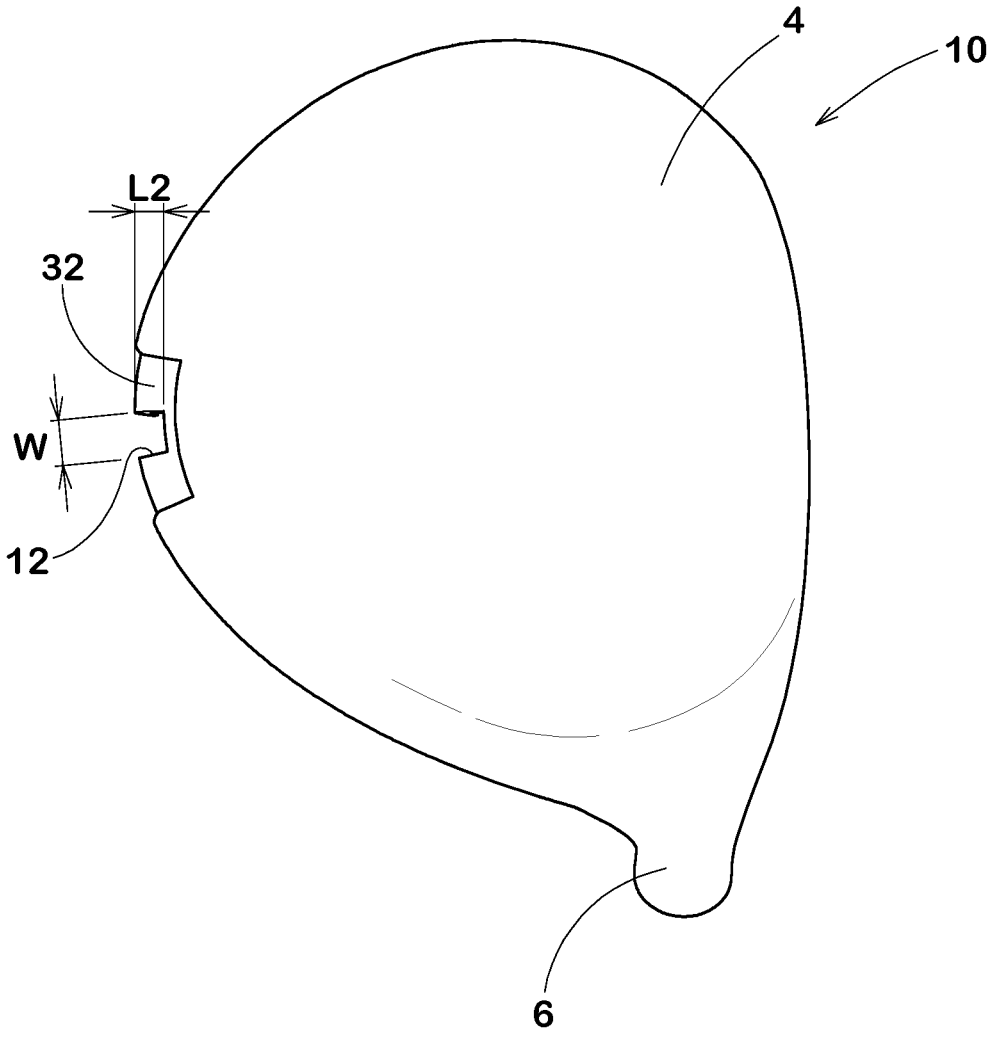
FIG. 9 is a bottom view of the club head main body.

FIGS. 7 to 9 show a rear view, a top view, and a bottom view, respectively, of the club head main body 10.

As shown, the club head main body 10 comprises the face portion 2, the crown portion 3, the sole portion 4, and a back-side outer rim portion 7.

[Back-Side Outer Rim Portion]

As shown in FIG. 8, the back-side outer rim portion 7 extends from the toe side to the heel side of the face portion 2 through between the crown portion 3 and the sole portion 4.

In the present embodiment, the back-side outer rim portion 7 defines a contour of the club head 1 which is, in the top view of the club head, on the rear side of the hosel portion 6. Here, the rear side of the hosel portion 6 means the rear side than the rearmost position 6*b* on the upper end surface of the hosel portion 6 as shown in FIG. 8.

For ease of understanding, in FIG. 8, there are shown a hosel rear line 6*c* which extends in the toe-heel direction through the rearmost position 6*b* on the upper end surface of the hosel portion 6, and the positions of intersections P1 and P2 of the hosel rear line 6*c* with the contour line of the club head.

The back-side outer rim portion 7 in the present embodiment is a portion extending from the toe-side intersection P1 to the heel-side intersection P2 which are of the hosel rear line 6*c* with the club head contour line as described above.

Further, the back-side outer rim portion 7 is a connecting portion of two head components: the crown portion 3 and the sole portion 4, which extend in different directions. Therefore, the back-side outer rim portion 7 inherently has high rigidity.

In the top view shown in FIG. 8, the back-side outer rim portion 7 in the present embodiment is curved so as to have an arcuate contour bulging toward the back side of the club head.

The club head main body 10 is provided with a crown opening 11 and a cutout 12.

[Crown Opening]

As shown in FIG. 8, the crown opening 11 is an opening formed in the crown portion 3.

Therefore, a part of the crown portion 3 is formed in the club head main body 10.

The contour shape of the crown opening 11 is not particularly limited, and various shapes may be adopted.

The crown opening 11 in the present embodiment is entirely located within the crown portion 3, and only one crown opening 11 is formed within the crown portion 3.

In the present embodiment, in order to design the center of gravity of the club head to be positioned forward, the crown opening 11 is formed closely to the rear of the crown portion 3. However, the crown opening 11 may be formed closely to the face, the toe, or the heel.

The opening edge 11*a* on the face portion 2 side of the crown opening 11 extends, for example, substantially parallel to the toe-heel direction of the club head.

The opening edge 11*b* on the rear side of the crown opening 11 smoothly extends on the inner side of the club head than the back-side outer rim portion 7, for example, along the back-side outer rim portion 7.

The crown opening 11 can reduce the mass of the crown portion 3 and produces a weight margin available for designing the center of gravity of the club head.

In order to obtain a larger weight margin, it is preferred that the crown opening 11 occupies at least 50%, more preferably at least 60% of the surface area of the crown portion 3.

For convenience, the surface area of the crown portion 3 is the area defined by the above-mentioned hosel rear line 6*c* and the back-side outer rim portion 7 in FIG. 8.

[Cutout]

Figure 10:
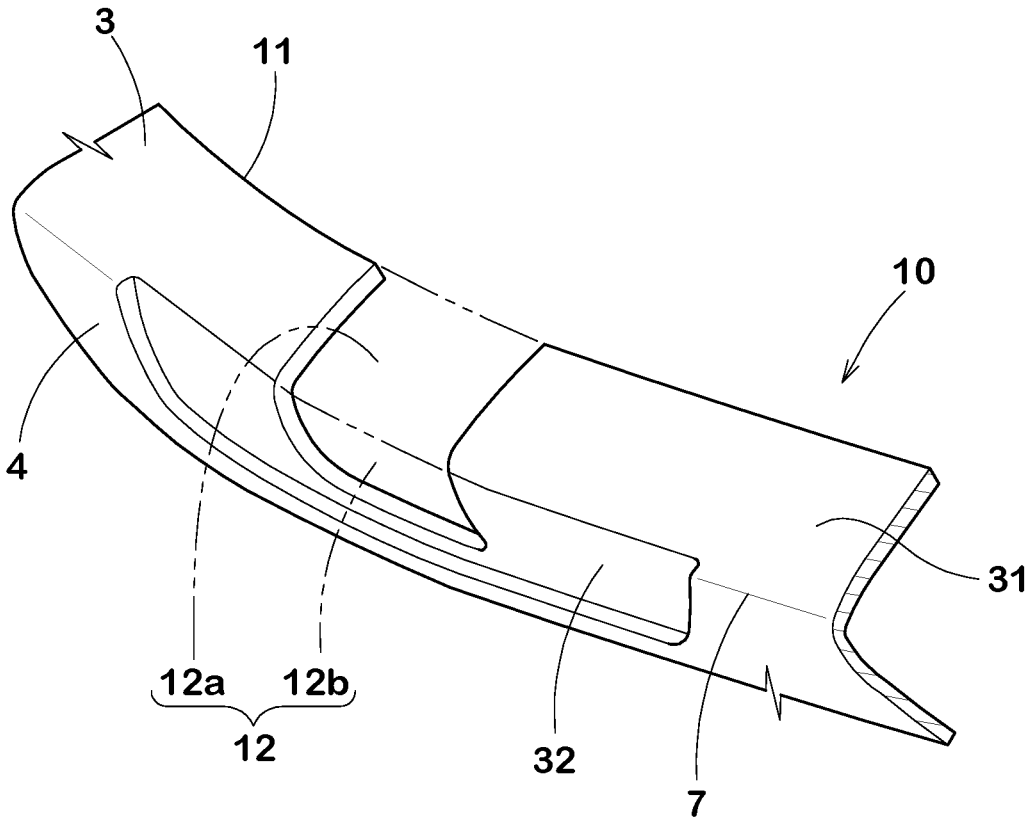
FIG. 10 is a perspective view of the cutout of the club head main body as viewed from the rear side of the club head.
Figure 11:
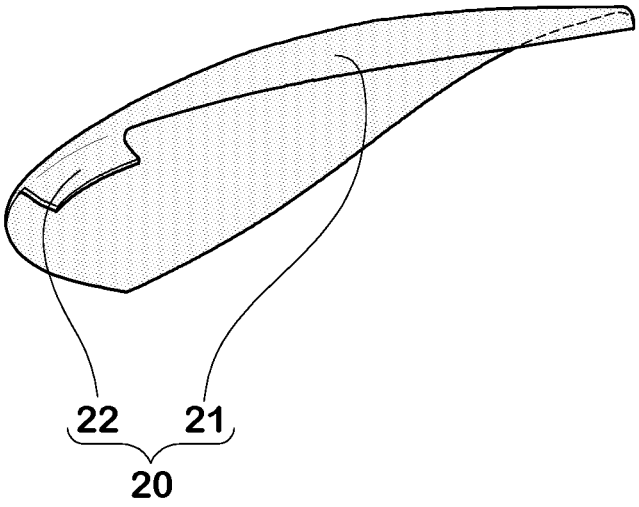
FIG. 11 is a perspective view of the cover member of the golf club head.
Figure 12:
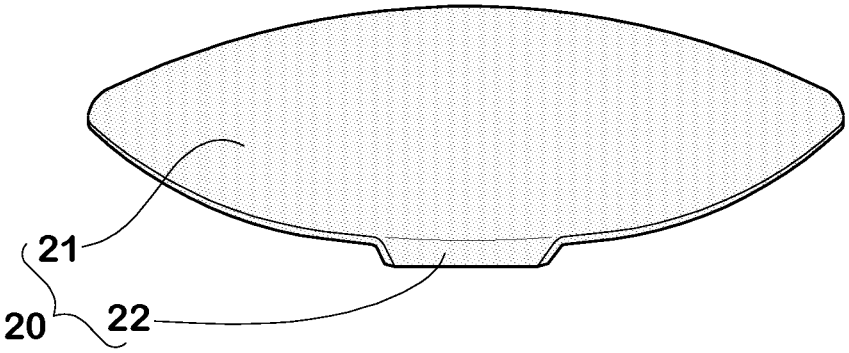
FIG. 12 is a rear view of the cover member.
Figure 13:
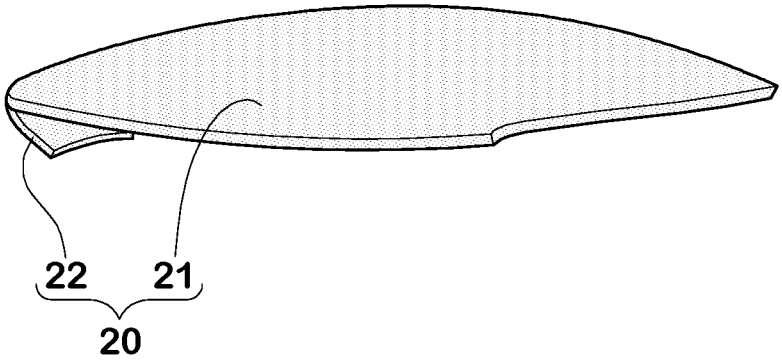
FIG. 13 is a side view of the cover member.

FIG. 10 is a perspective view showing a substantial part of the club head main body 10 as viewed from the rear side of the club head.

As shown in FIG. 10, the cutout 12 is an opening formed by a first opening 12*a* on the crown portion 3 side and a second opening 12*b* on the sole portion 4 side which are connected with each other in the back-side outer rim portion 7.

Preferably, the cutout 12 is formed so as to penetrate from the crown portion 3 to the sole portion 4 through the hollow (i) in the top view of the club head as apparent from FIG. 8.

In this embodiment, the cutout 12 is connected to the crown opening 11.

More specifically, the first opening 12*a* of the cutout 12 communicates with the crown opening 11 in the crown portion 3.

However, the cutout 12 may be formed separately from the crown opening 11. In this case, two or more independent openings will be formed in the crown portion 3.

The cutout 12 will bring various advantages. For example, as the back-side outer rim portion 7 is located far from the center of the club head, the mass distribution in the back-side outer rim portion 7 has a great influence on the design of the center of gravity of the club head 1. Therefore, by forming the cutout 12 in the back-side outer rim portion 7, it becomes possible to move the position of the center of gravity of the club head relatively largely.

In addition, the cutout 12 formed in the back-side outer rim portion 7 can effectively move the center of gravity of the club head even if the size of the cutout 12 is small.

Such small cutout 12 suppresses deterioration of the durability of the club head 1 and ball hitting sound.

Therefore, the club head 1 in the present embodiment can facilitate an efficient center of gravity design, while suppressing deterioration of the durability and hitting sound.

In addition, the back-side outer rim portion 7 has high rigidity, which prevents elastic deflection of the club head 1 when hitting a ball.

On the other hand, as the cutout 12 of the present embodiment partially reduces the rigidity of the back-side outer rim portion 7, the cutout 12 promotes the elastic bending deformation of the club head main body 10 starting from the cutout 12 at the time of hitting the ball, therefore, it is possible to improve the rebound performance.

Especially, when the cutout 12 penetrates the back-side outer rim portion 7 as in the present embodiment, the club head main body 10 is further flexed when hit the ball, and the rebound performance of the club head 1 is further improved.

[Cutout Width]

As shown in FIG. 8, in the top view of the club head main body 10, the width W of the cutout 12 in the back-side outer rim portion 7 is set in a range from 0.5% to 30% of the contour length of the back-side outer rim portion 7.

Here, the width W of the cutout 12 is a linear distance between both edges 12*e* of the cutout 12 in the back-side outer rim portion 7 as shown in FIG. 8.

The contour length of the back-side outer rim portion 7 is a length measured between the above-mentioned intersections P1 and P2 along the contour of the back-side outer rim portion 7, wherein the part of the contour which is interrupted by the cutout 12 is complemented by using the contour on both sides of the interrupted part to measure the contour length.

As described above, the cutout 12 formed in the back-side outer rim portion 7 can move the center of gravity of the club head efficiently even if the width W is small, therefore, the design freedom for the center of gravity of the club head is increased. On the other hand, if the width W is excessively small, the design freedom is decreased. From this point of view, the width W of the cutout 12 is 0.5% or more of the contour length of the back-side outer rim portion 7.

On the other hand, if the width W becomes excessively large, the rigidity of the entire head decreases as the rigidity of the back-side outer rim portion 7 decreases, which tends to deteriorate the durability of the club head 1 and the ball hitting sound.

In order to suppress such fundamental performances from deteriorating, the width W of the cutout 12 is set to be 30% or less of the contour length of the back-side outer rim portion 7.

In order to further increase the degree of freedom in designing the center of gravity, while suppressing the deterioration of the fundamental performances of the club head 1, it is preferred that the width W of the cutout 12 is not less than 1%, more preferably not less than 3% of the contour length of the back-side outer rim portion 7.

From the same viewpoint, the width W of the cutout 12 is preferably not more than 25%, more preferably not more than 20%, still more preferably not more than 10% of the contour length of the back-side outer rim portion 7.

In the present embodiment, each of the first opening 12*a* and the second opening 12*b* of the cutout 12 extends inwardly of the club head 1, while keeping the width W in the back-side outer rim portion 7.

[Cutout Length]

As shown in FIGS. 8 and 9, in the top view and the bottom view of the club head main body 10, the first opening 12*a* and the second opening 12*b* of the cutout 12 have lengths L1 and L2, respectively.

The lengths L1 and L2 are the opening lengths of the first opening 12*a* and the second opening 12*b* measured in the normal direction of the back-side outer rim portion 7.

Although not particularly limited, the lengths L1 and L2 of the cutout 12 are each set in a range from 30% to 200% of the width w in order to further increase the degree of freedom in designing the center of gravity, while suppressing the deterioration of the fundamental performances of the club head 1.

[Cutout Position]

The cutout 12 of the present embodiment is provided in the back-side outer rim portion 7, namely, the rearmost portion of the club head.

As a result, the mass is reduced in the rear part of the club head, which is useful for designing the center of gravity so that the center of gravity of the club head becomes closer to the face portion 2 (shallow center of gravity).

The shallow center of gravity of the club head can reduce the height of the sweet spot SS even for a head having a relatively large loft angle such as a fairway wood. In such golf club head, it becomes possible to bring ball hitting positions closer to the sweet spot SS, which helps to increase the flight distance of hit balls.

In order to design the center of gravity of the club head to be shallower, it is desirable that the cutout 12 is formed so as to include the rearmost position of the club head in the top view as shown in FIG. 8.

That is, the rearmost position P3 of the club head is located within the width in the toe-heel direction of the cutout 12 in the top view of the club head, as shown in FIG. 2.

Such arrangement helps to design the center of gravity of the club head to be shallower.

In FIG. 2, "G" denotes the center of gravity of the club head. In the embodiment shown in FIG. 2, the entire cutout 12 is positioned on the toe side of the center G of gravity of the club head.

[Number of Cutouts]

For example, a plurality of the cutouts 12 may be provided. In this case, the above-mentioned cutout width w should be the sum of the widths of the respective cutouts 12.

When a plurality of the cutouts 12 are provided, the degree of freedom in designing the center of gravity is further improved. For example, the center of gravity of the club head can be designed to be shallower and more on the heel side.

[Cover Member]

The cover member 20 is shown in FIG. 6 and FIGS. 11 to 13. The cover member 20 is made of a second material having a specific gravity smaller than that of the first material of the club head main body 10.

The second material is not particularly limited, but a low specific gravity material, for example, having a specific gravity of 2.0 or less is preferably used as the second material. For example, non-metal materials such as fiber reinforced plastics, e.g. carbon fiber reinforced plastics (CFRP) and the like, and low specific gravity metal materials, e.g. aluminum alloys, magnesium alloys and the like are preferably used as the second material.

The cover member 20 of the present embodiment is formed as a plate-shaped member made of a carbon fiber reinforced plastic.

Since the cover member 20 is made of the second material having a small specific gravity, the crown portion 3 of the club head 1 in the present embodiment is reduced in the mass, and thus the position of the center of gravity of the club head can be lowered.

In addition, the lightening of the crown portion can produce a weight margin that can be used for adjusting the position of the center of gravity of head when designing the center of gravity of the club head 1, and thus the degree of freedom in designing the center of gravity of head 1 is increased.

The cover member 20 comprises a crown cover 21 and a sole cover 22 which are integrally formed so that the sole cover 22 extends from the crown cover 21 into the sole portion 4, while turning back toward the front side.

The crown cover 21 has a size and a shape capable of closing at least the crown opening 11 and the first opening 12*a* of the cutout 12.

The sole cover 22 has a shape and a size capable of closing at least the second opening 12*b* of the cutout 12.

As the cover member 20 closes both of the crown opening 11 and the cutout 12 at once, the cover member 20 helps to improve the production efficiency of the club head 1.

Further, when assembling the club head, by applying the cover member 20 so as to sandwich the back-side outer rim portion 7 of the club head main body 10, the positioning of the cover member 20 becomes easy, and the production efficiency of the club head 1 is further improved.

As shown in FIG. 2, the crown cover 21 of the present embodiment is formed so as that its peripheral edge portion 21*a* to slightly and outwardly protrudes from the edges (shown by dotted line) of the crown opening 11 and the first opening 12*a*. The peripheral edge portion 21*a* of the crown cover 21 is fixed to the outer surface of a crown portion of the club head main body 10 using an adhesive agent, for example.

Here, the crown portion of the club head main body 10 corresponds to the crown portion 3 of the club head 1 excluding the crown cover 21.

As shown in FIG. 5, the sole cover 22 of the present embodiment is also formed so that its peripheral edge portion 22*a* protrudes from the edge (shown by dotted line) of the second opening 12*b*.

The peripheral edge portion 22*a* of the sole cover 22 is fixed to the outer surface of the sole portion 4 of the club head main body 10 by using the adhesive agent, for example.

[First Receiving Area]

Figure 6:
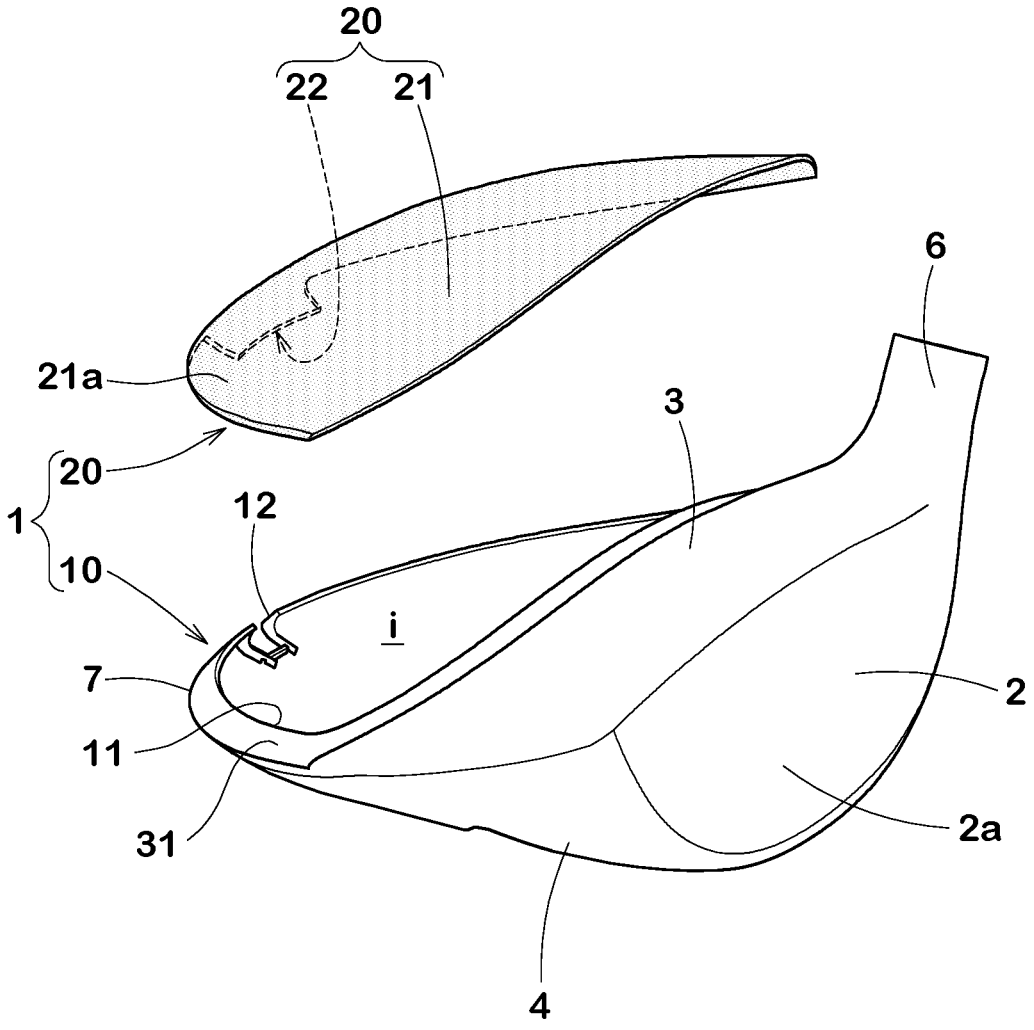
FIG. 6 is an exploded perspective view of the golf club head.

As shown in FIG. 6, the crown portion of the club head main body 10 is provided with a first receiving area 31 for supporting the underside of the peripheral edge portion 21*a* of the crown cover 21.

The first receiving area 31 is formed at least partially in the around portion of the crown opening 11.

For example, the first receiving area 31 may be formed as a recessed area which is slightly recessed toward the hollow (i) from the outer surface of the other area of the crown portion of the club head main body 10.

The recessed first receiving area 31 can reduce or eliminate a step between the outer surface of the crown cover 21 and the outer surface of the club head main body 10 which step may be formed when the peripheral edge portion 21*a* of the crown cover 21 is laid on the first receiving area 31. This helps to make these outer surfaces flush with each other.

[Second Receiving Area]

As shown in FIG. 10, a sole portion of the club head main body 10 is preferably provided with a second receiving area 32 for supporting the peripheral edge portion 22*a* (shown in FIG. 5) of the sole cover 22.

Here, the sole portion of the club head main body 10 corresponds to the sole portion 4 of the club head 1 excluding the sole cover 22.

The second receiving area 32 is formed around the cutout 12. The second receiving area 32 is formed as a recessed area recessed toward the hollow (i) from the outer surface of the sole portion 4 of the club head main body 10.

In the present embodiment, the peripheral edge portion 22*a* of the sole cover 22 is fitted into the recess of the second receiving area 32 as shown in FIG. 5.

The recessed second receiving area 32 can also reduce or eliminate a step between the outer surface of the sole cover 22 and the outer surface of the club head main body 10 which step may be formed when the peripheral edge portion of the sole cover 22 is laid on the second receiving area 32. This Helps to make these outer surfaces flush with each other.

Most preferably, the outer surface of the sole cover 22 of the cover member 20 fitted into the recess of the second receiving area 32 is made flush with the outer surface of the club head main body 10 around the second receiving area 32.

Figure 14:
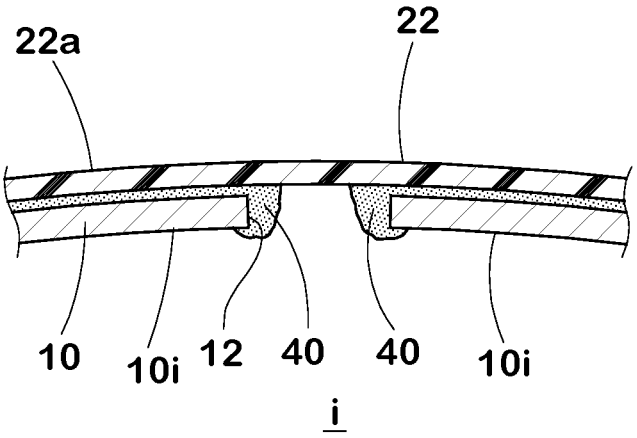
FIG. 14 is a cross-sectional view taken along line A-A of FIG. 5.

FIG. 14 is a cross sectional view taken along line A-A of FIG. 5. As shown, the peripheral edge portion 22*a* of the sole cover is fixed to the second receiving area 32 by the use of an adhesive agent 40.

The adhesive agent 40 is preferably extends (flows) from the second receiving area 32 to the inner surface 10*i* of the club head main body 10 beyond the open edge of the cutout 12. Thereby, the contact area between the adhesive agent 40 and the club head main body 10 is increased, and the bonding strength between the sole cover 22 and the club head main body 10 is increased, and as a result, the durability of the club head 1 can be improved.

It is not always necessary for the adhesive agent 40 to extend to the inner surface of the club head main body 10 over the entire length of the open edge of the cutout 12.

Even if a part of the length of the open edge of the cutout 12, the above effect may be obtained.

Modified Example

Figure 15:
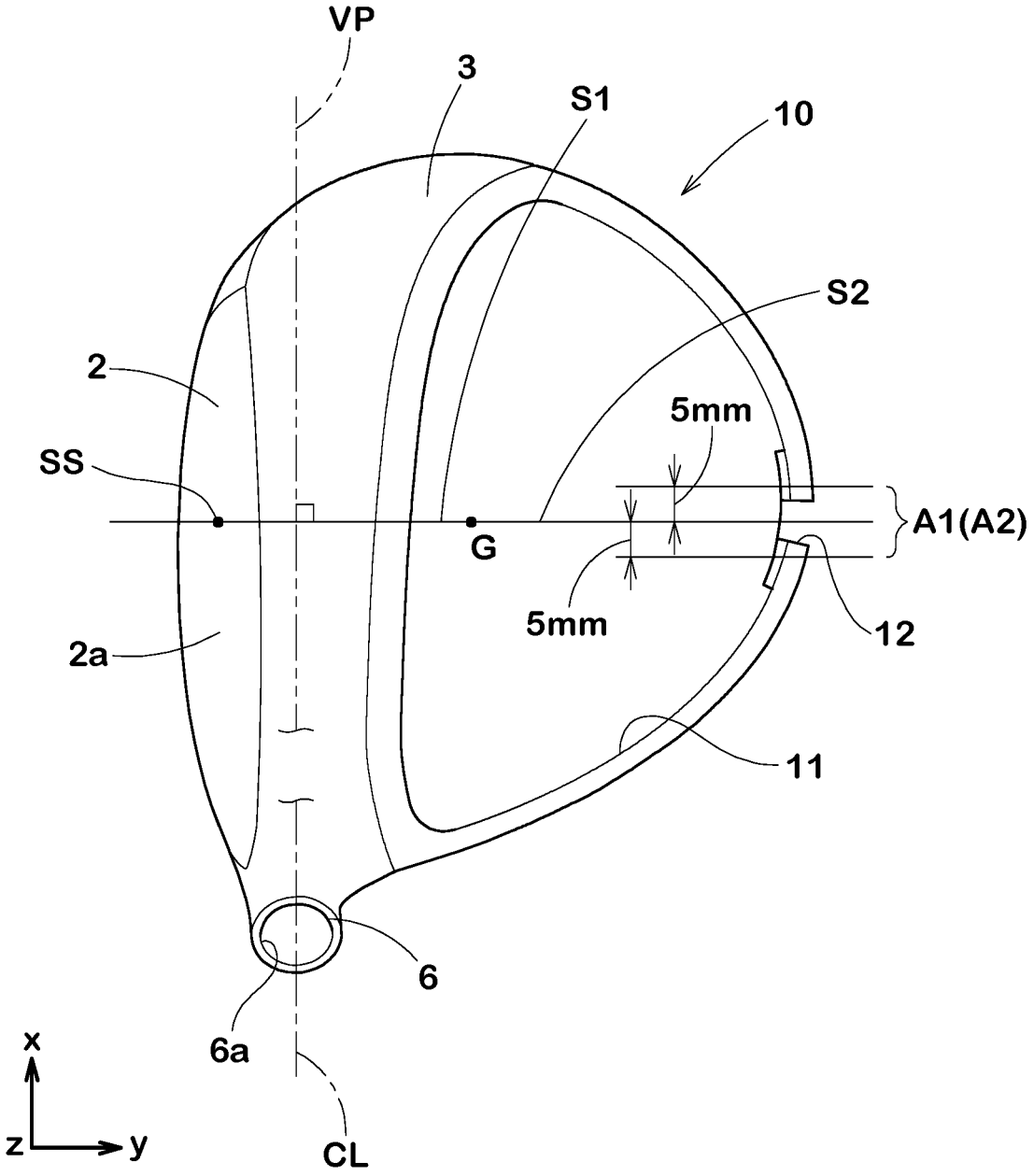
FIG. 15 is a top view of a modified example of the club head main body.

FIG. 15 is a top view of a modified example of the club head main body 10 of another embodiment of the present invention. As shown, the cutout 12 in this example is formed so as to overlap with a sweet spot rear area in the top view. The sweet spot rear area is a constant width area having a constant width of 10 mm in the toe-heel direction and extending backward from the sweet spot SS along its widthwise center line S1 extending parallel with the front-rear direction y passing through the sweet spot SS.

In this case, the bending deformation of the club head 1 when the ball hits the sweet spot SS (thus the bending deformation of the face portion 2) is furthered, and the rebound performance of the club head 1 is further improved. Preferably, the cutout 12 is formed so as to intersect with the widthwise center line S1 in the top view of the club head.

Incidentally, the sweet spot SS is the intersection of a straight line drawn normally to the ball striking surface 2*a* from the center G of gravity of the club head to the ball striking surface 2*a*.

In the top view of the club head, the cutout 12 may be formed so as to overlap with a gravity point rear area from the same viewpoint as the sweet spot rear area.

The gravity point rear area is a constant width area having a constant width of 10 mm in the toe-heel direction and extending backward from the center G of gravity along its widthwise center line S2 extending parallel with the front-rear direction y passing through the center G of gravity.

In the example shown in FIG. 15, the center G of gravity of the club head is positioned on the widthwise center line S1, but the present invention is not limited to such arrangement.

Figure 16:
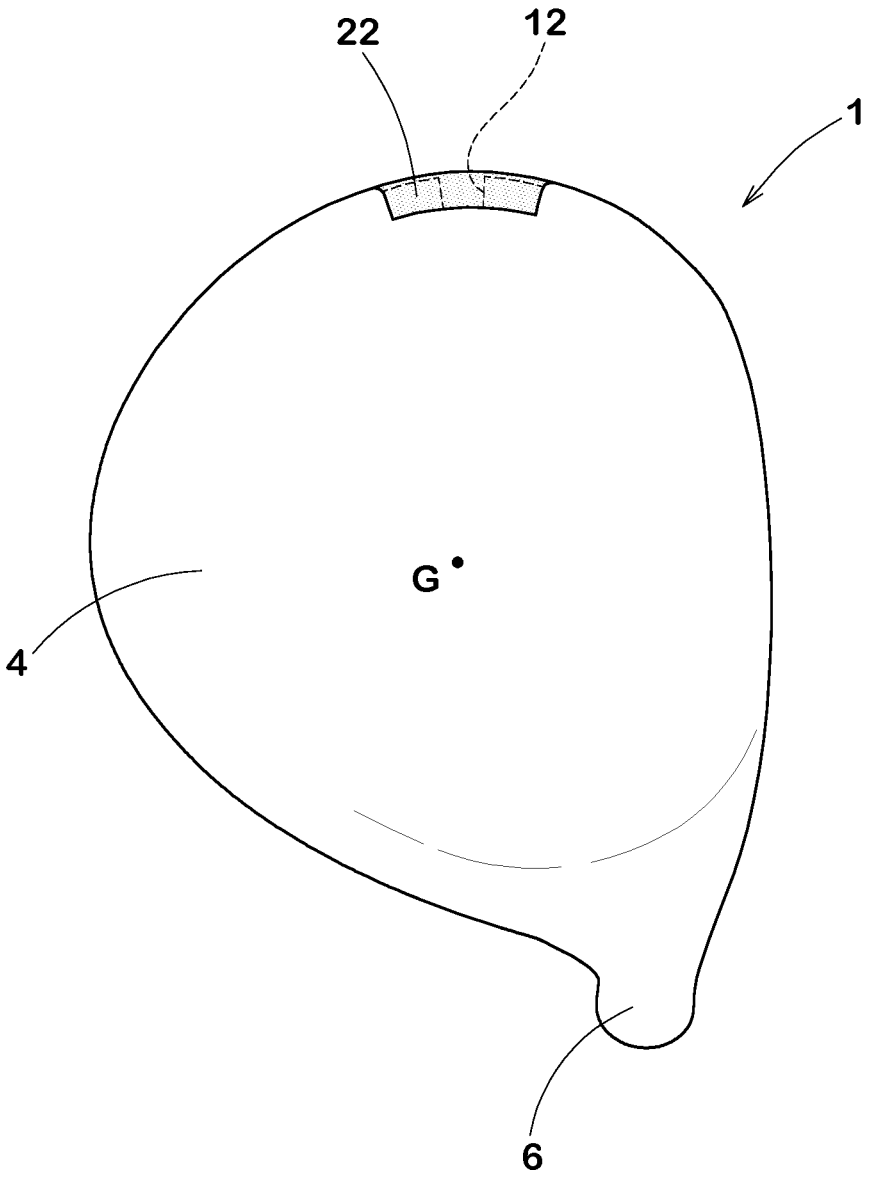
FIG. 16 is a bottom view of a modified example of the golf club head.

FIG. 16 is the bottom view of another embodiment of present invention, wherein the cutout 12 is formed on the toe side of the center G of gravity of the club head 1.

In this case, the center G of gravity of the club head can be shifted toward the heel.

This is effective in reducing the distance of the center G of gravity of the club head 1 from the axis of the club shaft so as to improve the returning rotational motion of the club head 1 during swing.

Further, as still another embodiment of present invention (not shown), the cutout 12 may be formed on the heel side of the center G of gravity of the club head in the top view of the club head 1.

While detailed description has been made of preferable embodiments of the present invention, the present invention can be embodied in various forms without being limited to the illustrated embodiments. In addition, the present invention can be embodied such that an embodiment includes the characteristic features of the above-disclosed embodiments. Furthermore, it goes without saying that the present invention includes equivalents of the above-described embodiments.

REFERENCE SIGNS LIST

1 golf club head
2 face portion
3 crown portion
4 sole portion
7 back-side outer rim portion
10 head main body
11 crown opening
12 cutout
12*a* first opening
12*b* second opening
20 cover member
21 crown cover
21*a* crown cover peripheral edge portion
22 sole cover
22*a* sole cover peripheral edge portion
31 first receiving area
32 second receiving area
i hollow
G center of gravity
SS sweet spot
W cutout width

The invention claimed is:

1. A golf club head with a hollow therein comprising:

a club head main body having a crown portion, a sole portion, and a back-side outer rim portion therebetween; and a cover member, wherein the club head main body is made of a first material, the club head main body is provided with a crown opening and a cutout, the crown opening is formed in the crown portion, the cutout is formed by a first opening on a crown portion side and a second opening on a sole portion side which are connected with each other in the back-side outer rim portion, in a top view of the club head, a width (W) of the cutout measured in the back-side outer rim portion is in a range from 0.5% to 30% of a contour length of the back-side outer rim portion, said width (W) of the cutout is not more than 10% of said contour length of the back-side outer rim portion, each of the first opening and the second opening of the cutout extends inwardly of the club head, while keeping said width (W) measured in the back-side outer rim portion, the cover member is made of a second material having a specific gravity smaller than that of the first material, the cover member integrally includes a crown cover and a sole cover which extends from the crown cover into the sole portion, the crown cover closes the crown opening and the first opening of the cutout, the sole cover closes the second opening of the cutout, the crown opening occupies 60% or more of a surface area of the crown portion, in the top view of the club head main body, the first opening has an opening length (L1) measured in a normal direction of the back-side outer rim portion which is 30% to 200% of said width (W) of the cutout measured in the back-side outer rim portion, and in the bottom view of a club head main body, the second opening has an opening length (L2) measured in a normal direction of the back-side outer rim portion which is 30% to 200% of said width (W) of the cutout measured in the back-side outer rim portion.

2. The golf club head according to claim 1, wherein the first opening of the cutout is connected to the crown opening.

3. The golf dub head according to claim 2, wherein in the top view of the club head, the cutout penetrates from the crown portion to the sole portion through the hollow.

4. The golf club head according to claim 3, wherein in the top view of the club head, the cutout is located so as to overlap with a region rearward of a center of gravity of the club head.

5. The golf club head according to claim 2, wherein in the top view of the club head, the cutout is located so as to include a position of the club head which position is most rearward of the club head.

6. The golf club head according to claim 2, wherein in the top view of the club head, the cutout is located within a region having a constant width of 10 mm in a toe-heel direction of the head and extending rearward from a sweet spot of a face portion along a widthwise center line of the region which extends parallel with a front-rear direction of the head passing through the sweet spot.

7. The golf club head according to claim 6, wherein at least a part of the club head main body around the cutout is provided with a receiving area for supporting the sole cover, and the sole cover is adhered to the receiving area by an adhesive agent which extends from the receiving area to an inner surface of the club head main body beyond an opening edge of the cutout.

8. The golf club head according to claim 2, wherein in the top view of the club head, the cutout is located so as to overlap with a region rearward of a center of gravity of the club head.

9. The golf club head according to claim 1, wherein in the top view of the club head, the cutout penetrates from the crown portion to the sole portion through the hollow.

10. The golf club head according to claim 9, wherein in the top view of the club head, the cutout is located so as to include a position of the club head which position is most rearward of the club head.

11. The golf club head according to claim 9, wherein in the top view of the club head, the cutout is located so as to overlap with a region rearward of a center of gravity of the club head.

12. The golf club head according to claim 1, wherein in the top view of the club head, the cutout is located so as to include a position of the club head which position is most rearward of the club head.

13. The golf club head according to claim 12, wherein in the top view of the club head, the cutout is located so as to overlap with a region rearward of a center of gravity of the club head.

14. The golf club head according to claim 1, wherein in the top view of the club head, the cutout is located within a region having a constant width of 10 mm in a toe-heel direction of the head and extending rearward from a sweet spot of a face portion along a widthwise center line of the region which extends parallel with a front-rear direction of the head passing through the sweet spot.

15. The golf club head according to claim 14, wherein at least a part of the club head main body around the cutout is provided with a receiving area for supporting the sole cover, and the sole cover is adhered to the receiving area by an adhesive agent which extends from the receiving area to an inner surface of the club head main body beyond an opening edge of the cutout.

16. The golf club head according to claim 1, wherein in the top view of the club head, the cutout is located so as to overlap with a region rearward of a center of gravity of the club head.

17. The golf club head according to claim 1, wherein in the top view of the club head, the cutout is located on a toe side of a center of gravity of the club head.

18. The golf club head according to claim 1, wherein in the top view of the club head, the cutout is located on a heel side of a center of gravity of the club head.

19. The golf club head according to claim 1, wherein the specific gravity of the second material may be 2.0 or less.

20. The golf club head according to claim 1, wherein at least a part of the club head main body around the cutout is provided with a receiving area for supporting the sole cover, and the sole cover is adhered to the receiving area by an adhesive agent which extends from the receiving area to an inner surface of the club head main body beyond an opening edge of the cutout.

* * * * *